US008129083B2

(12) United States Patent
Sakimura et al.

(10) Patent No.: US 8,129,083 B2
(45) **Date of Patent: *Mar. 6, 2012**

(54) ELECTROPHOTOGRAPHIC PHOTORECEPTOR AND IMAGE FORMING APPARATUS

(75) Inventors: Tomoko Sakimura, Tokyo (JP); Toyoko Shibata, Kanagawa (JP); Fumitaka Mochizuki, Tokyo (JP); Shinichi Hamaguchi, Tokyo (JP); Masanori Yumita, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 346 days.

This patent is subject to a terminal disclaimer.

(21) Appl. No.: 12/431,490

(22) Filed: Apr. 28, 2009

(65) Prior Publication Data

US 2009/0280419 A1 Nov. 12, 2009

(30) Foreign Application Priority Data

May 7, 2008 (JP) ..... 2008-121025

(51) Int. Cl.
*G03G 5/06* (2006.01)

(52) U.S. Cl. ..... 430/72; 430/58.75; 430/59.1

(58) Field of Classification Search ..... 430/58.75, 430/59.1, 72, 70, 71
See application file for complete search history.

(56) References Cited

U.S. PATENT DOCUMENTS

| | | | | |
|---|---|---|---|---|
| 4,925,760 | A * | 5/1990 | Baranyi et al. | 430/58.8 |
| 5,338,634 | A * | 8/1994 | Ueda | 430/58.75 |
| 2009/0011348 | A1 * | 1/2009 | Sakimura et al. | 430/58.25 |
| 2009/0148784 | A1 * | 6/2009 | Sakimura et al. | 430/58.8 |
| 2009/0154960 | A1 * | 6/2009 | Sakimura et al. | 399/220 |

* cited by examiner

*Primary Examiner* — Janis L Dote
(74) *Attorney, Agent, or Firm* — Lucas & Mercanti, LLP

(57) ABSTRACT

An electrophotographic photoreceptor is disclosed, comprising on or over an electrically conductive support a photosensitive layer containing a charge generation material and a charge transfer material, wherein the charge generation material is comprised of two or more compounds represented by the following formula wherein X and Y are each an alkyl group or a halogen atom, n is an integer of 1 to 6 and m is an integer of 0 to 6, and wherein the compounds differ in at least one of m and n of the formula.

6 Claims, 1 Drawing Sheet

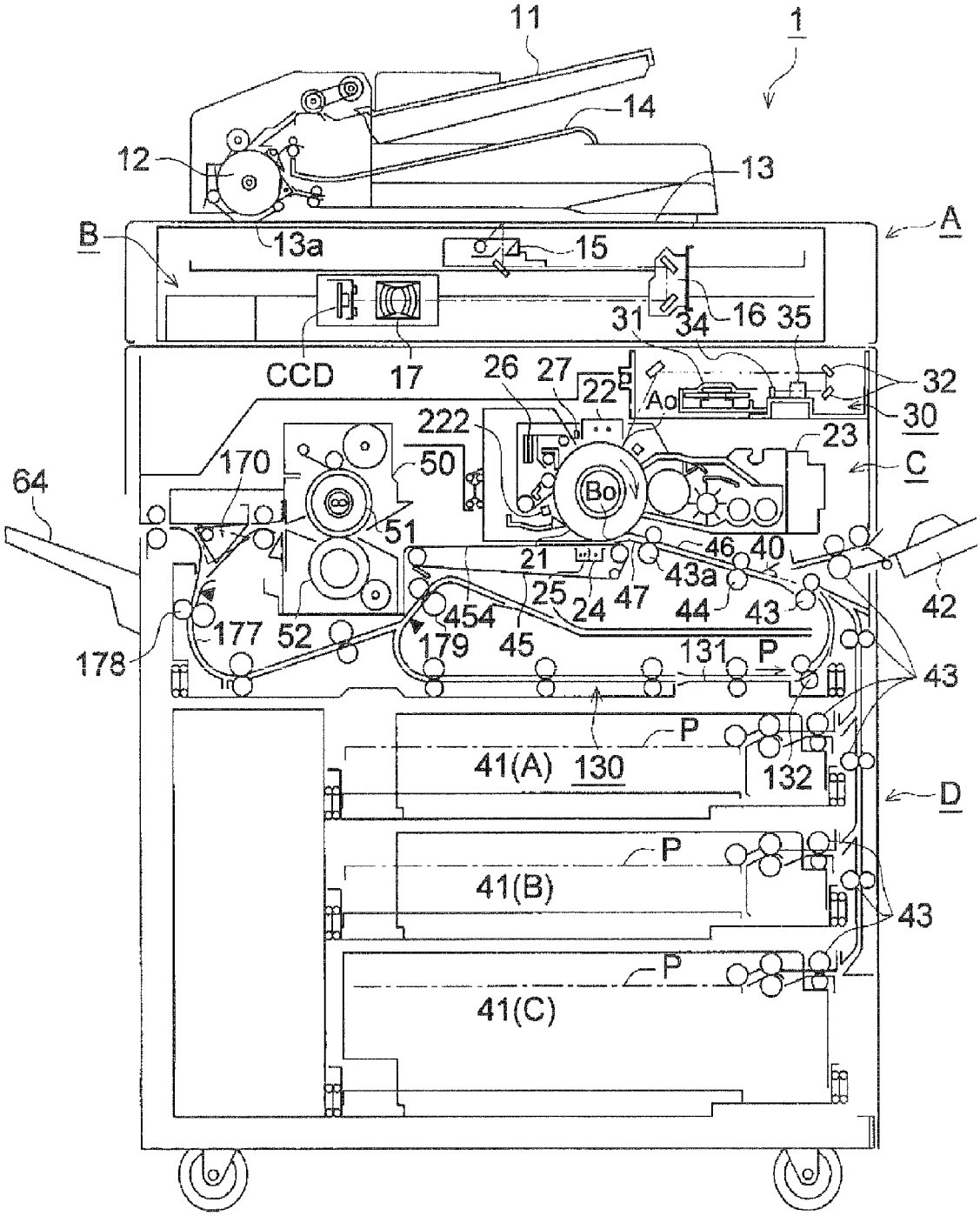
11
1
14
12
13
A
B
13a
15
16
35
31
34
CCD
17
26
27
22
Ao
32
30
222
23
C
170
50
64
Bo
51
46
40
21
43a
25
24
47
44
43
42
454
177
52
179
45
131
P
178
43
P
41(A)
130
132
D
P
41(B)
43
P
41(C)

ELECTROPHOTOGRAPHIC PHOTORECEPTOR AND IMAGE FORMING APPARATUS

CROSS REFERENCE TO RELATED APPLICATION

This Application claims the priority of Japanese Patent Application No. 2008-121025 filed May 7, 2008 the entire contents of which are hereby incorporated by reference.

FIELD OF THE PRESENT INVENTION

The present invention relates to an electrophotographic photoreceptor used for electrophotographic image formation and an image forming apparatus by use thereof.

BACKGROUND OF THE INVENTION

Recently, there have been increased opportunities of using electrophotographic copiers or printers in the field of printing or color printing. There is a strong trend of requiring high quality digital black-and-white or color images in such the field of printing or color printing. In response to such a requirement was proposed formation of high precision digital images by use of a short wavelength laser light. However, the current condition is that even when forming a precise electrostatic latent image on an electrophotographic photoreceptor by use of a short wavelength laser light and reducing the exposure diameter, the finally obtained electrophotographic image cannot achieve sufficiently high image quality.

The cause thereof is due to the fact that a photosensitive characteristic of an electrophotographic photoreceptor or an electrostatic characteristic of a developer toner is not fully provided with characteristics necessary for precise latent dot image formation or toner image formation.

In other words, organic photoreceptors (hereinafter, also denoted simply as a photoreceptor), which were developed as an electrophotographic photoreceptor used for conventional long wavelength lasers, were inferior in sensitivity characteristics and produced problems such that imagewise exposure with a short wavelength laser light at a reduced dot diameter resulted in an unclear dot latent image, rendering it difficult to obtain a satisfactory dot image.

There have been known anthanthrone pigments and pyranthrone compounds as a charge generation material of a photoreceptor for a short wavelength laser, as described in, for example, JP-A No. 2000-47408 (hereinafter, the term JP-A refers to Japanese Patent Application Publication).

Polycyclic quinone pigments such as anthanthrone pigments, as described in the foregoing patent document have no description of having been subjected to a special treatment and it is assumed to use commercial available ones. However, characteristics such as sensitivity, achieved by use of such commercially available pigments were difficult in satisfying sufficient sensitivity or a high-speed characteristic for high-speed printers or copiers using a short wavelength laser.

To enhance sensitivity, as is well known, a charge generation material is granulated to form a charge generation layer having an enhanced density of the charge generation material. However, application of this granulation technique to a photoreceptor used for a short wavelength laser achieves improved sensitivity itself but tends to produce image defects due to memory generated by repetition of electrostatic-charging in the step of charging or transfer during image formation or due to minute electric charge leakage.

SUMMARY OF THE INVENTION

The present invention has come into being in view of the foregoing problems and it is an object of the invention to stably provide an electrophotographic photoreceptor exhibiting enhanced sensitivity upon exposure to a short wavelength light at a lasing wavelength of 380 to 500 nm. Specifically, it is an object of the present invention to provide an electrophotographic photoreceptor which does not lower sensitivity when exposed to a so-called short-wavelength light source at a lasing wavelength in the range of 380 to 500 nm and exhibits almost no variation in electric potential at the lighted and unlighted portions even after repeated use. It is another object of the present invention to provide an electrophotographic photoreceptor capable of forming printed images without causing image defects such as black spots and achieving excellent fine-dot reproduction as well as fine-line reproduction.

The foregoing objects of the invention were achieved by the following constitution.

Thus, one aspect of the present invention is directed to an electrophotographic photoreceptor comprising on or over an electrically conductive support a photosensitive layer containing a charge generation material and a charge transfer material, wherein the charge generation material is comprised of two or more compounds represented by the following formula (1):

Formula (1)

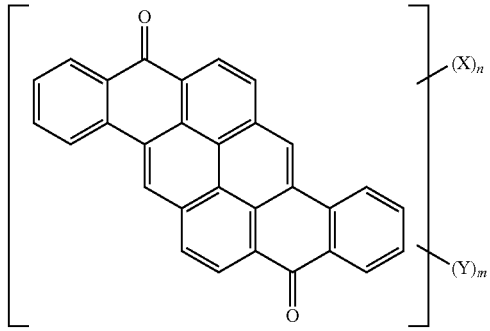

wherein X and Y are each an alkyl group or a halogen atom, n is an integer of 1 to 6 and m is an integer of 0 to 6, and wherein the said two or more compounds differ in at least one of m and n of the formula (1).

Another aspect of the present invention is directed to an image forming apparatus in which an electrophotographic photoreceptor described above is exposed to light by using an exposure device having an emission wavelength of 380 to 500 nm and an exposure dot diameter of 10 to 50 nm in the main-scanning direction for writing-in.

According to the present invention, there is provided an electrophotographic photoreceptor exhibiting enhanced sensitivity characteristics when exposed to a short-wavelength light having a lasing wavelength of 380 to 500 nm. Thus, the electrophotographic photoreceptor related to the present invention exhibited slight lowering of sensitivity when exposed to a short-wavelength light having a lasing wavelength in the range of 380 to 500 nm and also resulted in little variation in electric potential in exposed and unexposed portions even when repeatedly exposed. Further, it was confirmed that performing print formation by using an electrophotographic photoreceptor relating to the present invention achieved faithful reproduction of dot images and fine-line images, without causing image trouble such as black spots.

There has been studied by the inventors of this application an electrophotographic photoreceptor (hereinafter, also denoted simply as a photoreceptor) exhibiting enhanced sensitivity characteristics when exposed to a short-wavelength light having a lasing wavelength of 380 to 500 nm and superior electric-potential stability, and resulting in highly precise image formation without causing image defects.

First, there was made a trial of preparing a photoreceptor having a charge generation layer containing only one charge generation material of a specific structure As a result, it was proved that such a photoreceptor could not achieve high sensitivity upon exposure to a short-wavelength light having a lasing wavelength of 380 to 500 nm, and producing problems in potential stability when repeatedly exposed.

In general, a charge generation layer is formed by coating and drying a coating solution of a charge generation material which has been dispersed in a solution of a binder resin dissolved in an organic solvent. It is considered to be essential to allow a charge generation material to be homogeneously dispersed in a charge generation layer. However, charge generation materials generally tend to coagulate, so that insufficient dispersion results in a coating solution containing coarse particles. A charge generation layer formed by use of such a coating solution tends to cause a local potential leakage of a photoreceptor which is due to coarse particles, resulting in instability of electric characteristics and image defects (such as black spots and fogging). Therefore, it is essential to perform sufficient dispersion of a charge generation material in the process of preparing a coating solution for a charge generation layer to inhibit inclusion of coarse particles. On the other hand, enhanced dispersion of a charge generation material by employing high dispersion shear results in formation of a coating layer of homogeneous dispersion, while such dispersion shear causes a change of the crystal structure of the charge generation material, resulting in impaired characteristics and tending to produce problems in sensitivity and charge stability.

Further extensive study by the inventors of this application found that a photoreceptor having a charge generation layer formed of a mixture of two or more charge generation materials of a specific structure exhibited enhanced sensitivity and stable potential characteristics even when repeatedly exposed to light, and producing no image defect, as compared to a photoreceptor having a charge generation layer formed of a single charge generation material.

It is presumed to be assigned to the fact that the mixed use of two or more charge generation materials of a specific structure results in enhanced dispersion of the charge generation materials, forming a homogeneous charge generation layer containing no coarse particle even if dispersion is not performed at a dispersion strength of causing a change of the crystal structure of the charge generation materials.

Specifically, it was confirmed that, in a photoreceptor provided with a photosensitive layer containing a charge generation material and a charge transfer material on an electrically conductive support, the charge generation material is comprised of two or more charge transport compounds represented by the formula (1):

formula (1)

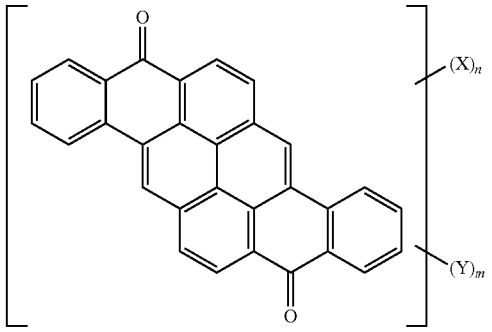

wherein X and Y are each an alkyl group or a halogen atom, n is an integer of 1 to 6 and m is an integer of 0 to 6, provided that the two or more charge transport compounds differ in at least one of "m" and "n" of the formula (1).

BRIEF DESCRIPTION OF THE DRAWINGS

FIG. 1 illustrates an example of an image forming apparatus in which an electrophotographic photoreceptor in accordance with the present Invention is illustrated.

DETAILED DESCRIPTION OF THE INVENTION

There will be further detailed the present invention.

First, there will be described a charge generation material usable in the present invention (hereinafter, also denoted simply as a charge generation material).

Charge Generation Material

The charge generation material usable in the present invention is composed of two or more compounds represented by the foregoing formula (1). In the formula (1), X and Y, each represents an alkyl group or a halogen atom, n represents an integer of 1 to 6 and m represents an integer of 0 to 6. Preferably, at least one of X and Y is a halogen atom; more preferably, X is a halogen atom and still more preferably X is a bromine atom.

C-1

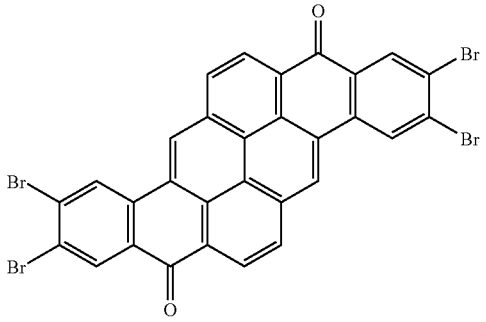

-continued
C-2
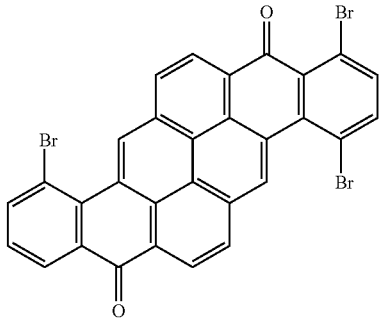
C-3
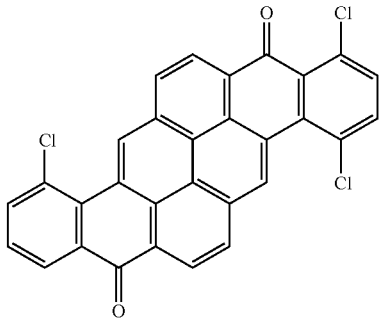
C-4
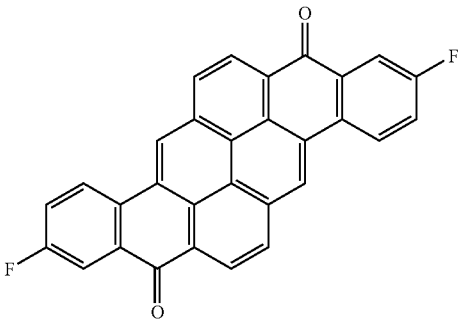
C-5
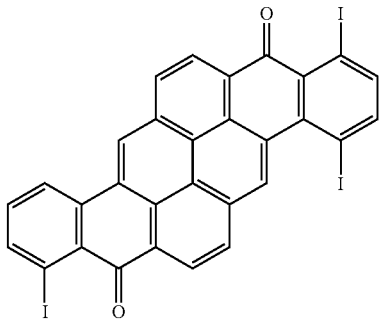
-continued
C-6
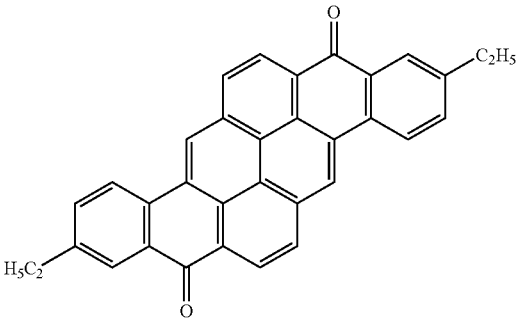
C-7
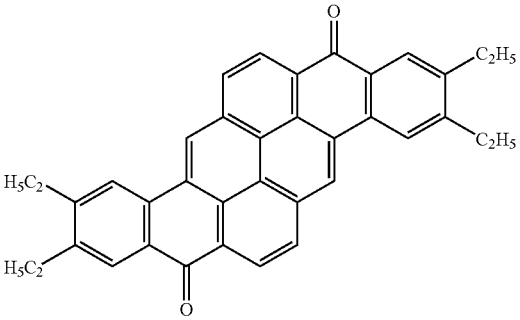
C-8
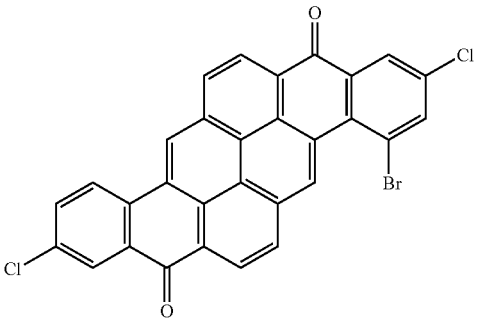
C-9
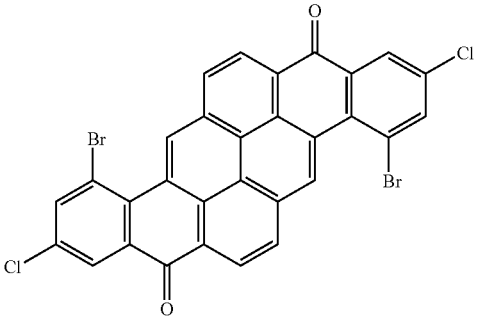

-continued
C-10
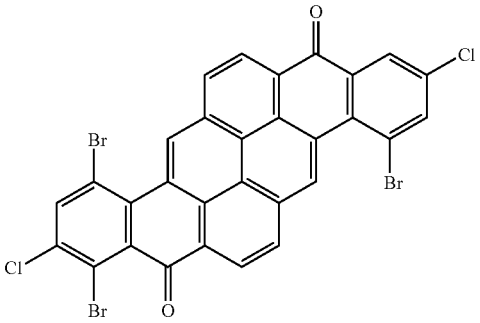
C-11
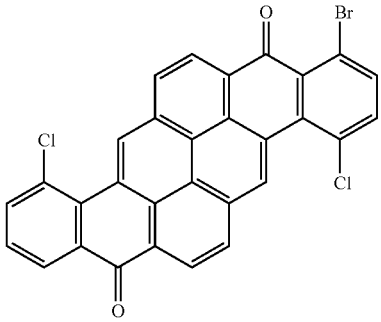
C-12
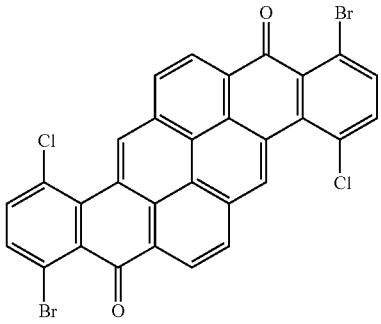
C-13
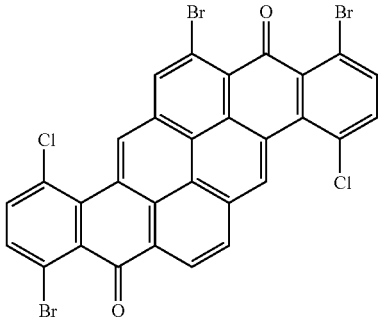
C-14
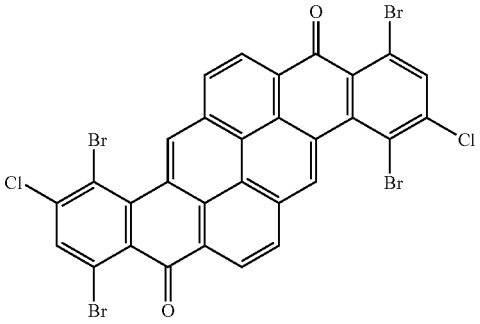
-continued
C-15
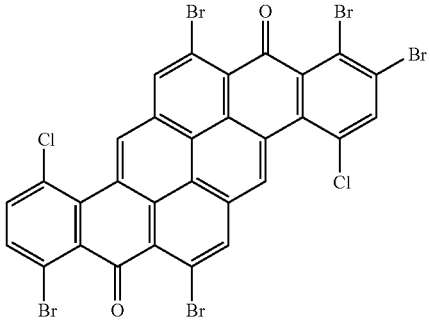
C-16
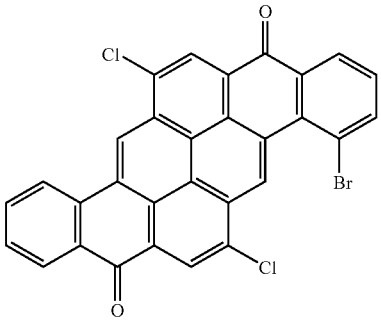
C-17
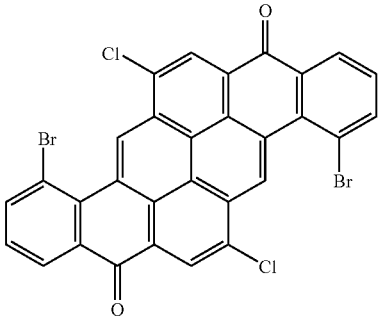
C-18
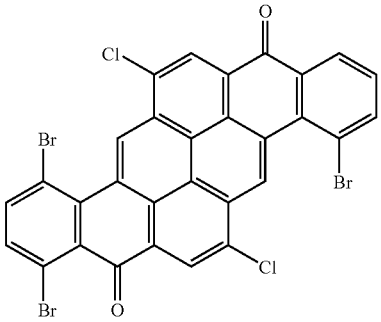
C-19
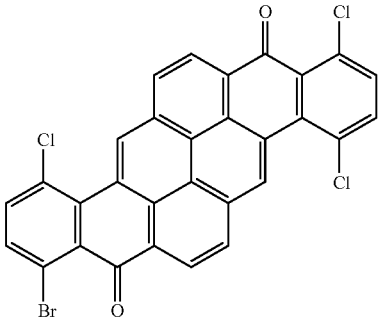

-continued
C-20
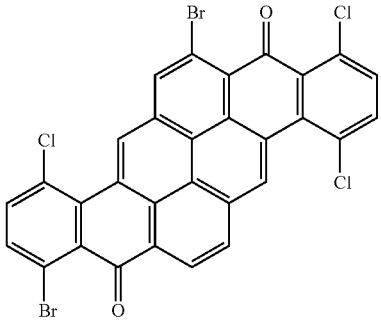
C-21
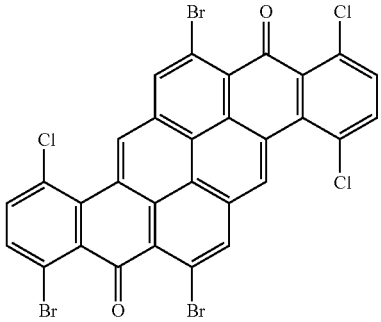
C-22
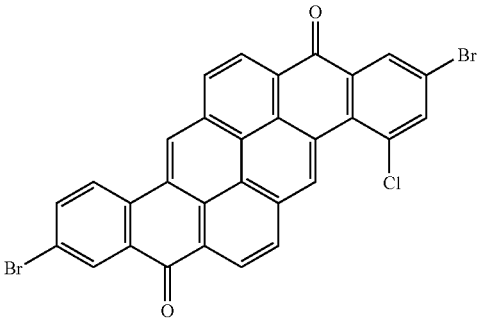
C-23
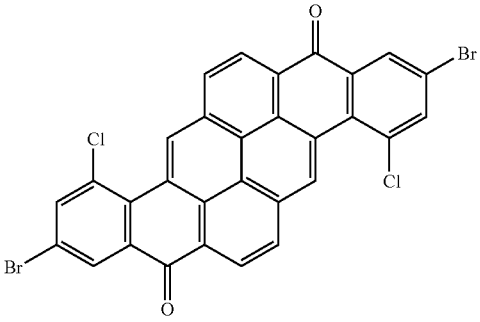
-continued
C-24
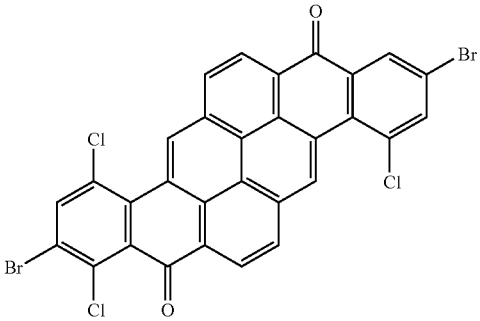
C-25
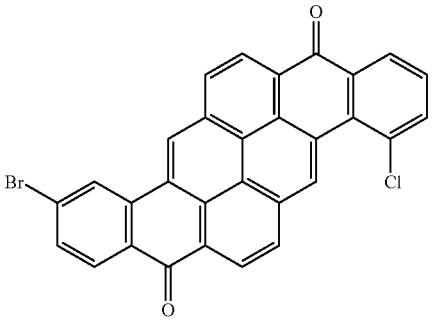
C-26
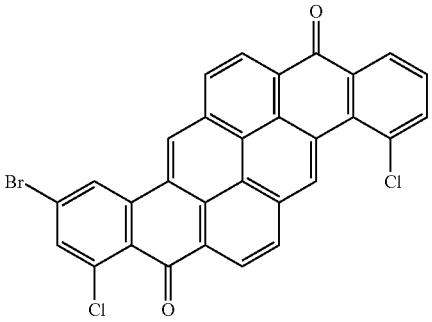
C-27
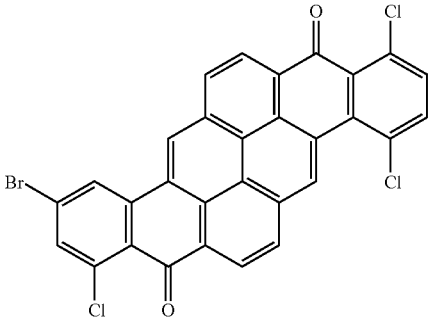
C-28
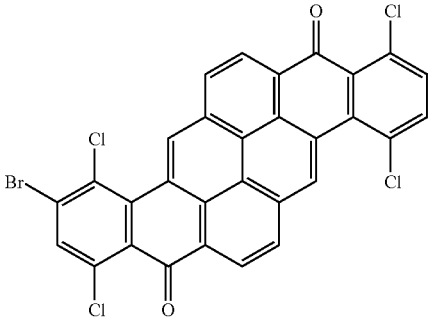

-continued
C-29
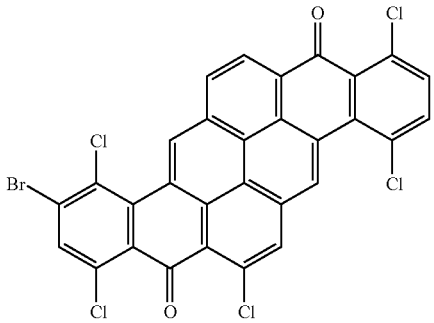
C-30
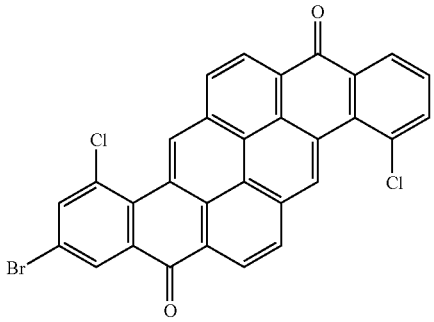
C-31
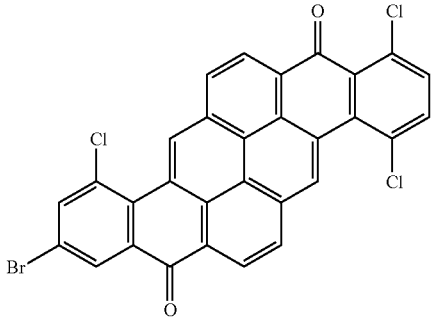
C-32
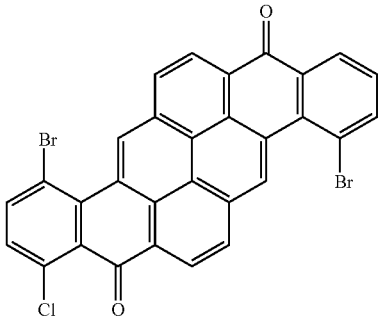
C-33
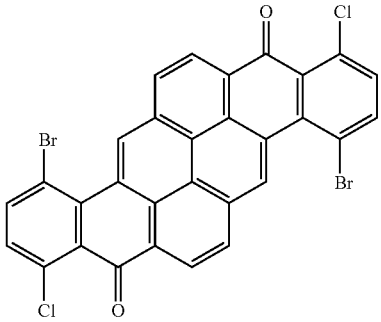
-continued
C-34
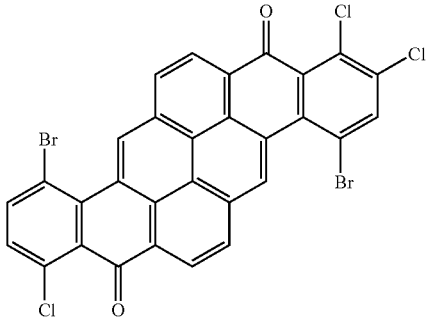
C-35
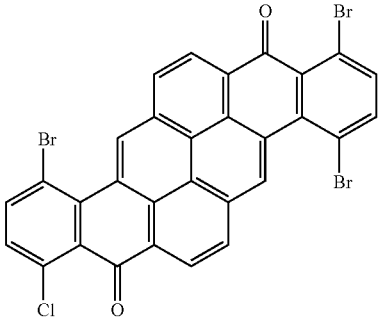
C-36
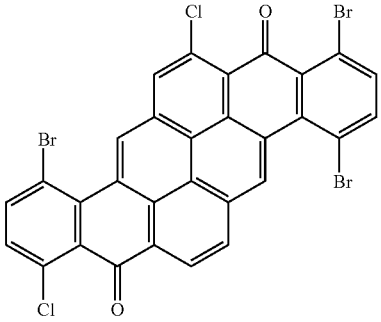
C-37
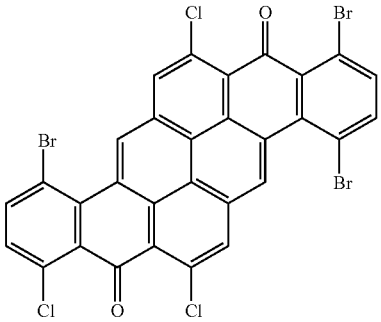
C-38
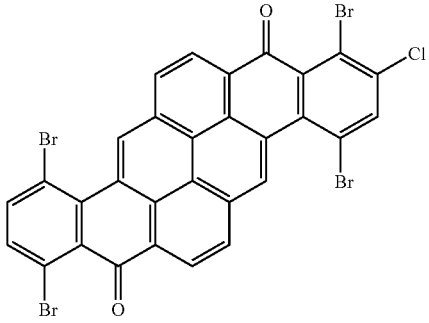

-continued

C-39

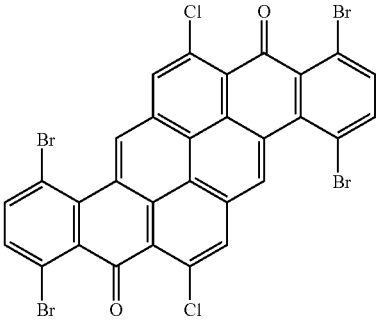

C-40

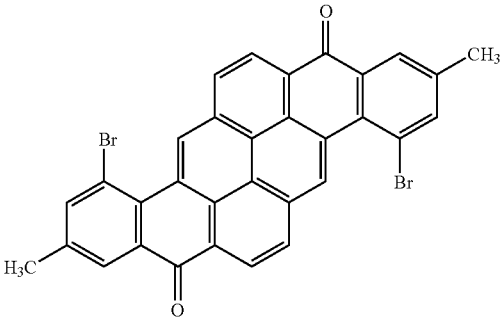

C-41

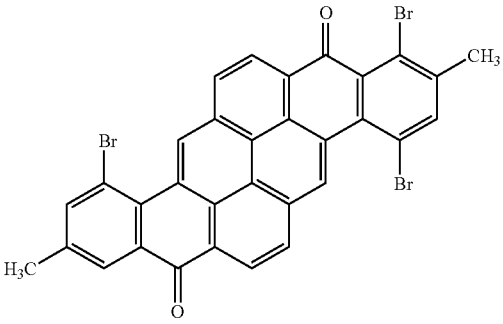

C-42

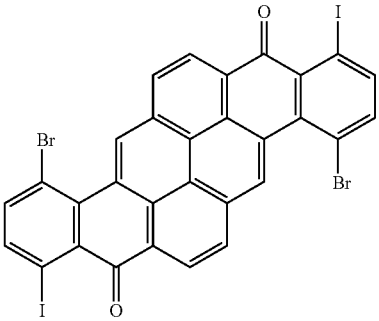

-continued

C-43

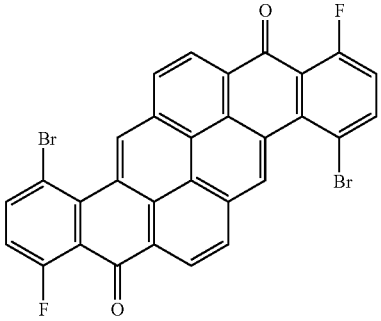

The charge generation material of the present invention is composed of two or more compounds of the formula (1), wherein a compound which has the highest proportion of the compounds preferably accounts for not more than 90% by mass of the total of the compounds.

Further, in a preferred embodiment of the present invention, a compound of the formula (1) in which X is a bromine atom and n is 4, accounts for a maximum proportion of the compounds represented by the formula (1). Further, in a preferred embodiment of the present invention, a compound represented by the formula (1) in which X is a bromine atom, Y is a chlorine atom, n is 2 and m is 2, accounts for a maximum proportion of the compounds represented by the formula (1).

The number of attached halogen atoms (e.g., bromine atom and chlorine atom) in the molecular structure of the pyranthrone compound represented by the foregoing formula (1) can be controlled by varying the added amount of halogens. The number of attached halogen atoms in the molecular structure of the pyranthrone compound can be determined in commonly used mass spectrometry.

Next, there will be described constitution of the photoreceptor of the present invention.

Constitution of Photoreceptor

The electrophotographic photoreceptor relating to the present invention comprises a photosensitive layer containing a charge generation material and a charge transfer material on or over an electrically conductive support and is preferably a so-called layered structure in which a charge generation layer and a charge transfer layer are successively layered to form a photosensitive layer. It is also preferred to provide an interlayer between the electrically conductive support and the photosensitive layer and is also preferred to provide a surface protective layer on the photosensitive layer.

In the following, an electrically conductive support, an interlayer and a photosensitive layer constituting the electrophotographic photoreceptor will be described with reference to specific preferred examples.

Conductive Support

Electrically conductive supports usable in the photoreceptor relating to the present invention include sheet-form or cylindrical ones.

A cylindrical conductive support, which is capable of endless image formation on a photoreceptor through rotation of the photoreceptor, preferably has a cylindricality of 5 to 40 μm, and more preferably 7 to 30 μm. The cylindricality is defined in JIS specification (B0621-1984). Thus, when a cylindrical substrate is sandwiched in between two coaxial geometrical cylinders, the position at which the distance between the cylinders is the shortest is represented by a difference in radius between the cylinders (that is a circularity). In the present invention, the difference is represented in terms of μm.

A cylindricality is determined by measurement of circularity at two points of both 10 mm ends of the cylindrical substrate, at the center point, and four of the points equally three-divided between the center and the end, that is, for a total of seven points. Examples of an instrument for cylindrical degree measurement include a non-contact versatile roll diameter measurement instrument (produced by Mitsutoyo Co., Ltd.).

Materials used for an electrically conductive support include, for example, a metal cylinder such as aluminum or nickel, a plastic resin drum on which aluminum, tin oxide, indium oxide or the like is deposited and a Japanese paper or plastic drum which is coated with electrically conductive material. A specific resistivity as an electric characteristic of a conductive support is preferably not more than $10^2$ Ωcm at ordinary temperature (e.g., 25° C.).

There may be used a conductive support, the surface of which has been subjected to a sealing treatment to form an alumite layer. An alumite treatment is conducted usually in an acidic bath such as chromic acid or sulfuric acid, oxalic acid, phosphoric acid, boric acid, or sulfamic acid. Of these, it is specifically preferred to subject the support surface to an anodic oxidation treatment by using sulfuric acid. An anodic oxidation treatment in sulfuric acid is conducted preferably by setting conditions at a sulfuric acid concentration of 100 to 200 g/l, an aluminum ion concentration of 1 to 10 g/l, a liquid temperature of approximately 20° C. and an applied voltage of approximately 20 V but is not limited to these conditions. The average thickness of the formed anodic oxidation film is usually not more than 20 μm, preferably not more than 10 μm.

Interlayer

The electrophotographic photoreceptor relating to the present invention may be provided with an interlayer between a conductive support and a photosensitive layer. Such an interlayer preferably contains N-type semiconductor particles. The N-type semiconductor particles refer to particles exhibiting the property of the main charge carrier being electrons. In other words, since the main charge carrier is electrons, the interlayer using N-type semiconductor particles exhibits properties of efficiently blocking hole-injection from the substrate and reduced blocking for electrons from the photosensitive layer. Preferred N-type semiconductor particles include titanium oxide ($TiO_2$) and zinc oxide (ZnO), of which the titanium oxide is specifically preferred.

N-type semiconductor particles employ those having a number average primary particle size of 3 to 200 nm, and preferably 5 to 100 nm. The number average primary particle size is a Feret-direction average diameter obtained in image analysis when N-type semiconductor particles are observed by a transmission electron microscope and 1,000 particles are randomly observed as primary particles from images magnified at a factor of 10000. In cases when the number average primary particle size of N-type semiconductor particles is less than 3 nm, it becomes difficult to disperse the N-type semiconductor particles in a binder constituting an interlayer and the particles are easily aggregated, so that the aggregated particles act as a charge trap, making it easy to cause a transfer memory.

When the number average primary particle size is more than 200 nm, N-type semiconductor particles cause unevenness on the interlayer surface, tendering to cause non-uniformity of images via such unevenness. Further, when the number average primary particle size is less than 200 nm, N-type semiconductor particles easily precipitate in the dispersion, often causing image non-uniformity.

Crystal forms of titanium oxide particles include an anatase type, rutile type, brookite type and the like. Of these, rutile type or anatase type titanium oxide particles effectively enhance rectification of a charge passing the interlayer. Thus, mobility of electrons is enhanced to stabilize the charging potential, and increase of residual potential is inhibited, contributing to high-density dot image formation.

Formation of an interlayer in the electrophotographic photoreceptor relating to the present invention employs preparation of an interlayer coating solution and coating it, in which the interlayer coating solution contains a binder and a dispersing solvent in addition to N-type semiconductor particles such as surface-treated titanium oxide.

The proportion of N-type semiconductor particles in the interlayer is preferably 1.0 to 2.0 times the binder resin in the interlayer by volume (in which the volume of a binder resin is set at 1). Such a high-density proportion in the interlayer results in enhanced rectification of the interlayer, rendering it difficult to cause an increase of residual potential or occurrence of transfer memory. Accordingly, occurrence of black spots is inhibited and variation in electric potential is minimized.

Photosensitive Layer

Charge Generation Layer

The electrophotographic photoreceptor relating to the present invention employs, as a charge generation material, a compound represented by the formula (1) described earlier. In the present invention, conventionally known charge generation materials may be used in combination with the foregoing pyranthrone compound.

A binder constituting a charge generation layer can employ commonly known resins and specifically preferred examples thereof include a formal resin, a butyral resin, a silicone resin, a silicone-modified butyral resin and a phenoxy resin. The ratio of a charge generation material to a binder resin is preferably 20 to 600 parts by mass to 100 parts by mass of a binder resin. The use of these resins can restrain increased residual potential accompanied with repeated use. The thickness of a charge generation layer is preferably 0.3 to 2 μm.

Charge Transport Layer

A charge transport layer is composed of a charge transport material and a binder to disperse the charge transport material to form the layer. There may optionally be incorporated additives such as an antioxidant, in addition to the foregoing constituents.

A charge transport material is preferably an organic compound exhibiting low absorptivity for a laser light with an emission wavelength in the range of 380 to 500 nm. The charge transport layer may be composed of plural charge transport layers.

In the present invention, it is preferred to use, as a charge transport material, at least one charge transport compound represented by the following formula (2):

formula (2)

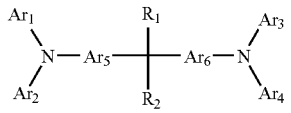

wherein $Ar_1$ to $Ar_4$ are each independently an aryl group which may be substituted, $Ar_5$ and $Ar_6$ are each independently an arylene group which may be substituted, provided that $Ar_1$ and $Ar_2$ or $Ar_3$ and $Ar_4$ may combine with each other to form a ring; $R_1$ and $R_2$ are each independently a hydrogen atom, or an alkyl group, an aralkyl group or an aryl group which may be substituted, provided that $R_1$ and $R_2$ may combine with each other to form a ring.

Of the compounds represented by the foregoing formula (2) is preferred a charge transport compound represented by the following formula (3), in which the foregoing $Ar_5$ and $Ar_6$ are each a phenylene group which may be substituted:

formula (3)

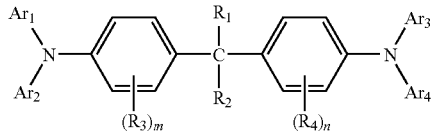

wherein $R_1$ and $R_2$ are each independently an alkyl group or an aryl group, provided that $R_1$ and $R_2$ may combine with each other to form a ring structure; $R_3$ and $R_4$ are each independently a hydrogen atom, an alkyl group or an aryl group; $Ar_1$ to $Ar_4$ are each the same as defined in the foregoing formula (2); m and n are each an integer of 1 to 4.

Specific examples of the compound represented by the foregoing formula (3) are shown below.

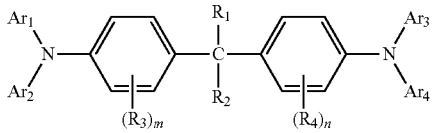

| CTM-No. | $Ar_1$ | $Ar_3$ | $Ar_2$ | $Ar_4$ |
|---|---|---|---|---|
| CTM-1 | 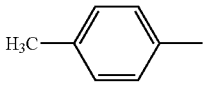 | 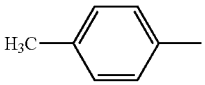 | 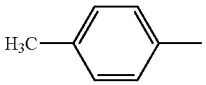 | 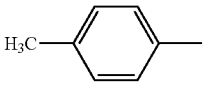 |
| CTM-2 | 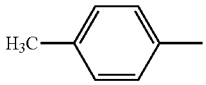 | 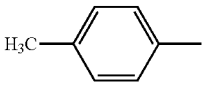 | 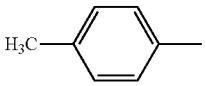 | 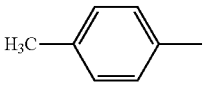 |
| CTM-3 | 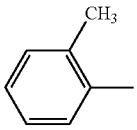 | 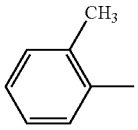 | 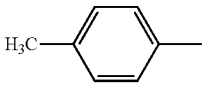 | 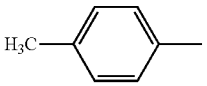 |
| CTM-4 | 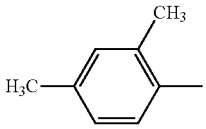 | 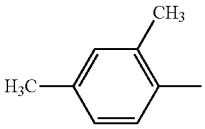 | 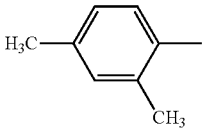 | 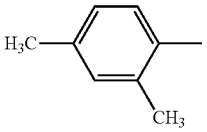 |
| CTM-5 | 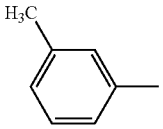 | 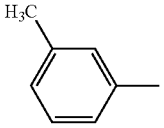 | 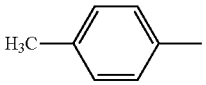 | 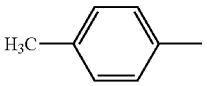 |
| CTM-6 | 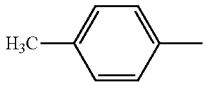 | 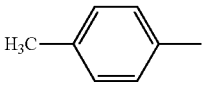 | 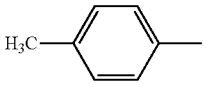 | 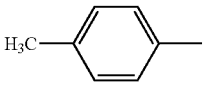 |
| CTM-7 | 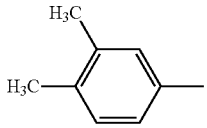 | 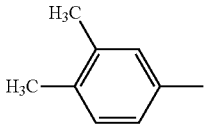 | 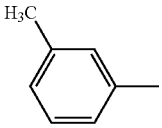 | 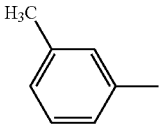 |
| CTM-8 | 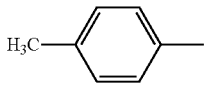 | 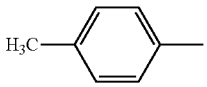 | 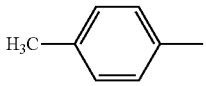 | 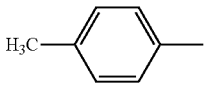 |
| CTM-9 | 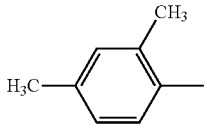 | 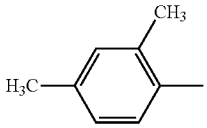 | 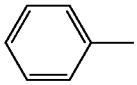 | 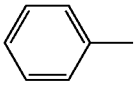 |

-continued
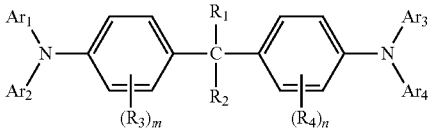
CTM-10
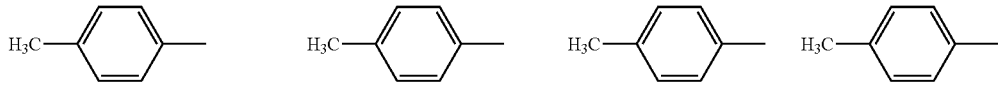
CTM-11
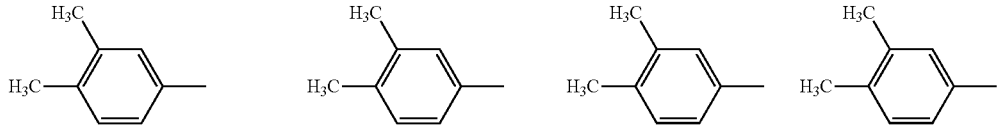
CTM-12
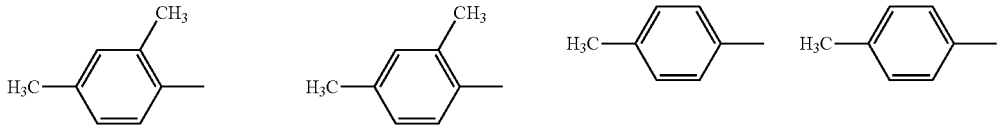
CTM-13
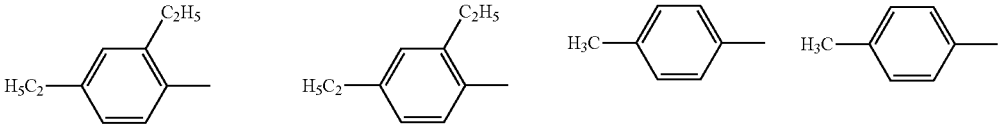
CTM-14
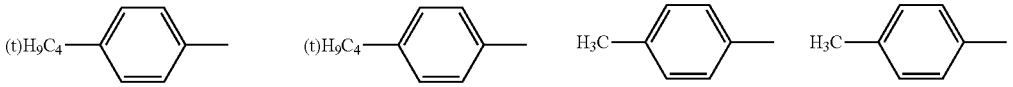
CTM-15
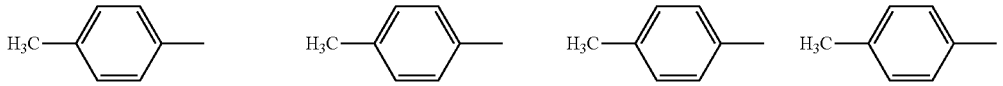
CTM-16
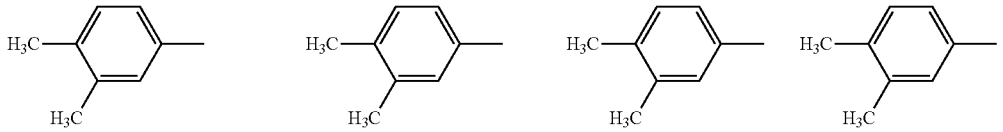
CTM-17
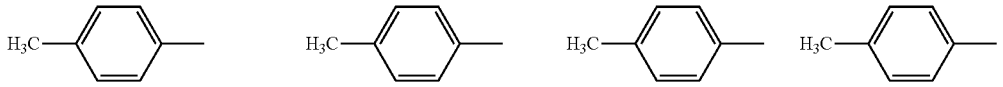
CTM-18
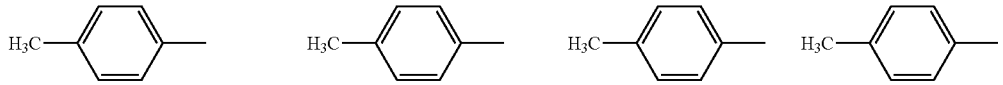
CTM-19
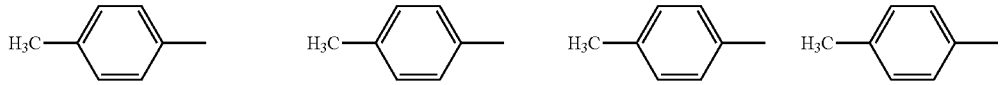
CTM-20
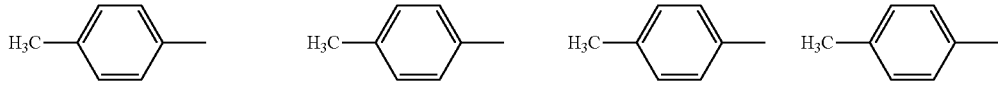
CTM-21
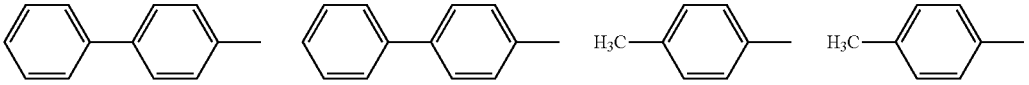
CTM-22
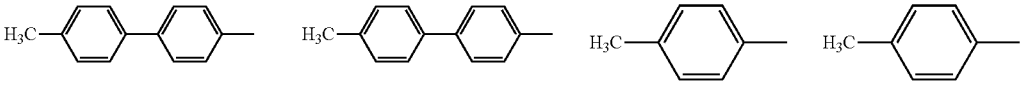

-continued
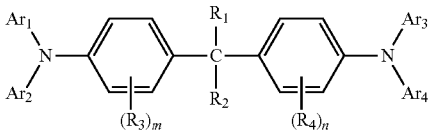
CTM-23
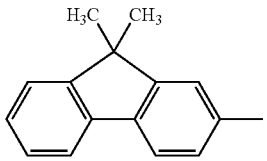
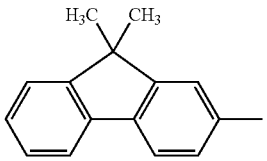
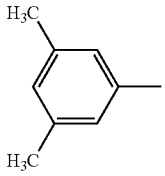
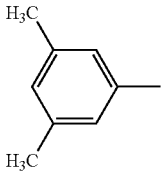
| CTM-No. | $R_1$ | $R_2$ | 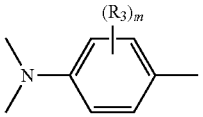 | 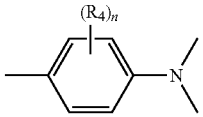 |
|---|---|---|---|---|
| CTM-1 | —$CH_3$ | —$CH_3$ | 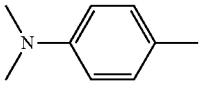 | 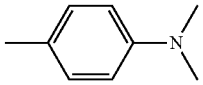 |
| CTM-2 | —$CH_3$ | —$C_2H_5$ | 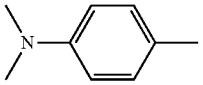 | 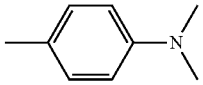 |
| CTM-3 | —$CH_3$ | —$C_3H_7$(i) | 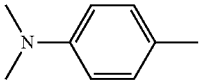 | 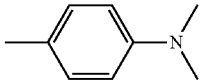 |
| CTM-4 | —$CH_3$ | —$C_4H_9$(n) | 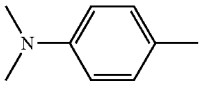 | 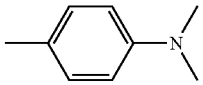 |
| CTM-5 | —$CH_3$ | 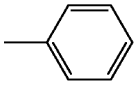 | 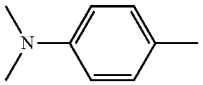 | 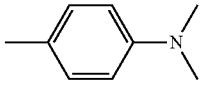 |
| CTM-6 | | 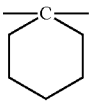 | 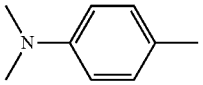 | 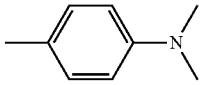 |
| CTM-7 | —$CH_3$ | —$CH_3$ | 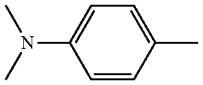 | 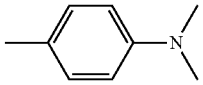 |
| CTM-8 | —H | —H | 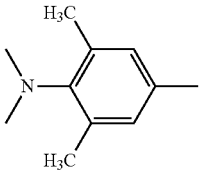 | 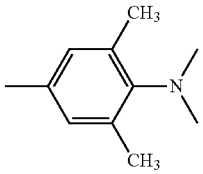 |
| CTM-9 | —$CH_3$ | —$CH_3$ | 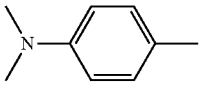 | 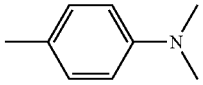 |

-continued
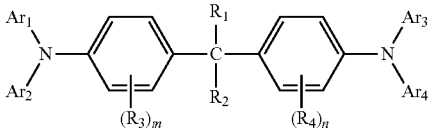
| | | | | |
|---|---|---|---|---|
| CTM-10 | | 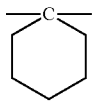 | 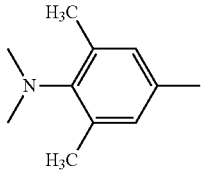 | 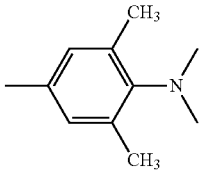 |
| CTM-11 | | 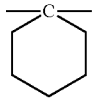 | 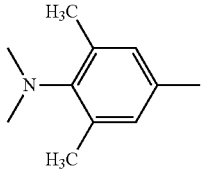 | 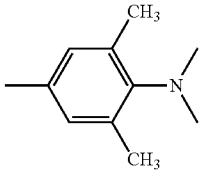 |
| CTM-12 | | 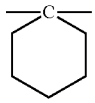 | 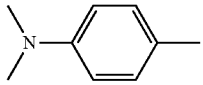 | 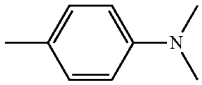 |
| CTM-13 | | 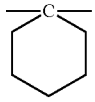 | 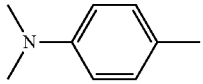 | 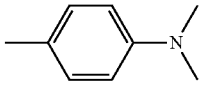 |
| CTM-14 | | 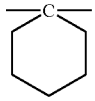 | 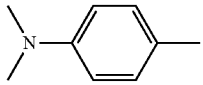 | 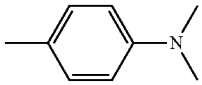 |
| CTM-15 | $—C_2H_5$ | $—C_2H_5$ | 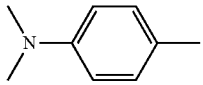 | 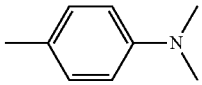 |
| CTM-16 | —H | $—CH(CH_3)CH_2CH_3$ | 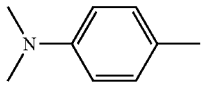 | 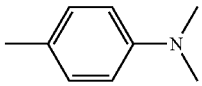 |
| CTM-17 | $—CH_3$ | $—CH_2CH(_3)_2$ | 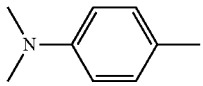 | 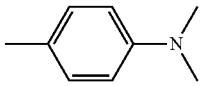 |
| CTM-18 | | 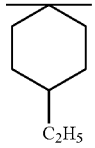 | 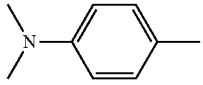 | 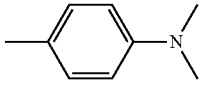 |
| CTM-19 | | 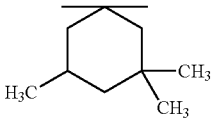 | 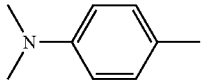 | 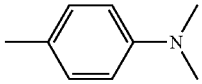 |

-continued

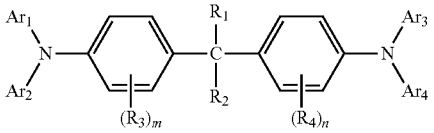

| | | | |
|---|---|---|---|
| CTM-20 | 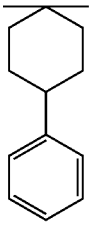 | 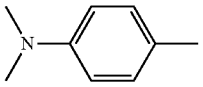 | 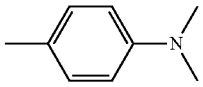 |
| CTM-21 | 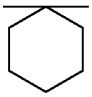 | 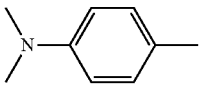 | 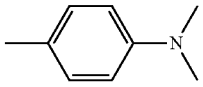 |
| CTM-22 | 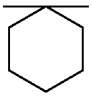 | 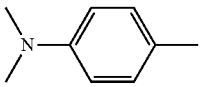 | 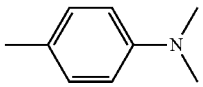 |
| CTM-23 | 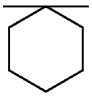 | 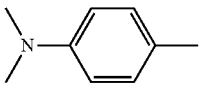 | 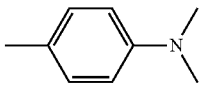 |

CTM-X

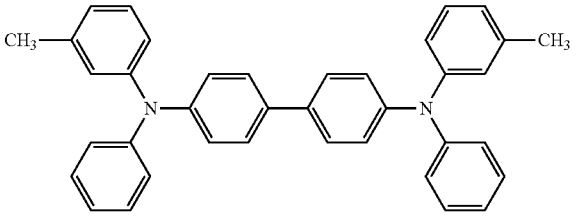

Compounds represented by formula (3) can be synthesized according to commonly known methods. A synthesis example of CTM-6 as one of compounds represented by formula (3) is shown below.

Synthesis Example of Compound (CTM-6):

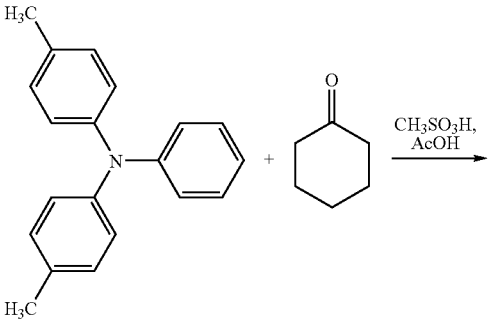

-continued

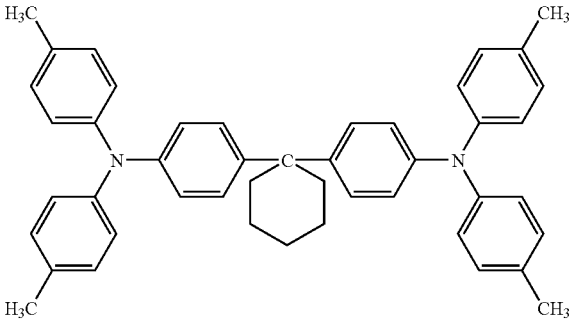

CTM-6

There will be described a synthesis scheme of the foregoing CTM-6. First, a four-necked flask is provided with a cooler, a thermometer and a nitrogen introducing tube and a magnetic stirrer is set thereto. The interior of the flask is evacuated and completely replaced by nitrogen. Into the flask were successively added compounds described below:

| | |
|---|---|
| N,N-bis(4-methylphenyl)aniline | 4.00 parts by mass |
| Cyclohexane | 2.00 parts by mass |
| Acetic acid | 14.00 parts by mass |
| Methanesulfonic acid | 0.09 parts by mass |

This mixture solution is reacted at 70° C. for 8 hr. Thereafter, formed solids are washed with acetone and recrystallized in tetrahydrofuran (THF) and acetone to obtain an objective CTM-6. The thus obtained CTM-6 can be identified by mass spectrometry (MS) or nuclear magnetic resonance (NMR).

In addition to the compound represented by formula (2) or (3) are usable commonly known positive-hole transporting (P-type) charge transfer material (CTM) as a charge transport material (CTM) usable in photoreceptors relating to the present invention. Examples thereof include triphenylamine derivatives, hydrazine compounds, styryl compounds, benzidine compounds and butadiene compounds. Using these charge transport materials, a charge transport layer can be formed with a coating solution prepared by dissolving these charge transport materials in an appropriate binder resin. Of charge transport materials described above are preferably used ones which exhibit low absorption of laser light at an emission wavelength of 380 to 500 nm and enhanced charge transportability, and the compound represented by formula (2) or (3) is specifically preferred.

A binder resin usable in the charge transport layer may be any one of thermoplastic resins and thermo-setting resins. Specific examples of a binder resin include thermo-plastic resins such as a polystyrene resin, polyacrylic resin, polymethacrylic resin, polyvinyl acetate resin and polyvinyl butyral resin. There are also included condensation type polymer materials such as a polyester resin, polycarbonate resin, epoxy resin and polyurethane resin. Examples of a thermosetting resin include a phenol resin, alkyd resin and melamine resin. In addition to these resins is also usable a silicone resin. There are also usable a copolymer resin having at least two of repeating unit structures constituting the resins described above and resins using at least two of the resins in combination, so-called polymer blends. Further, in addition to these resins are also cited polymer organic semiconductors, such as polyvinyl carbazole. Of these resins described above is specifically preferred a polycarbonate resin which exhibits low water absorptivity, capable of performing uniform dispersion of a charge transport material and also exhibits favorable electrophotographic characteristics.

The ratio of charge transport material to binder resin is preferably 50 to 200 parts by mass to 100 parts by mass of a binder resin. The total thickness of a charge transport layer is preferably not more than 30 μm, more preferably 10 to 25 μm. A thickness of more than 30 μm easily causes absorption or scattering of a short wavelength laser within the charge transport layer, resulting in a lowering of image sharpness, which is disadvantageous for high resolution image formation. Further, an increase of residual potential easily occurs, which becomes disadvantageous for repeated image formation.

In the following, there will be described an image forming apparatus in which an electrophotographic photoreceptor relating to the present invention can be installed and an image forming method by use of the image forming apparatus.

Image Forming Apparatus

FIG. 1 illustrates an example of an image forming apparatus in which an electrophotographic photoreceptor can be loaded.

An image forming apparatus 1, which is capable of forming images by a digital system, is composed mainly of an image reading section A, an image processing section B, an image forming section C and a transfer paper conveyance section D.

An automatic document feeder to automatically convey documents is provided above the image reading section A and a document held on a document-holding plate 11 is separated and conveyed sheet by sheet by a document conveying roller so that images are read at a reading position 13*a*. A document having completed image reading is disposed onto a document disposing plate 14 the document conveying roller 12.

The image forming apparatus 1 of FIG. 1 can perform reading by placing a document sheet by sheet on a platen glass 13 as well as automatic image reading, as described above. Reading an original image on the platen glass 13 is achieved by moving each of a lighting lamp constituting a scanning optical system, a first mirror unit 15 comprised of the first mirror and a second mirror unit 16 of a structure disposing two mirrors in a V-form. In the image forming apparatus of FIG. 1, reading an original image is performed at a moving speed of the first mirror unit 15 of "v" and a moving speed of the second mirror unit 16 of "v/2".

The image which has been read on the image reading section A by the procedure described above is converted to a digital image signal in the subsequent image processing section B. In the image processing section B, the image read in the image reading section A is formed on the light-receiving surface of an imaging element CCD of a line-sensor through a projector lens 17. Optical images formed in-line on the imaging element CCD are successively photoelectric-converted to electric signals (luminance signal) and further subjected to A/D (analog/digital) conversion. Then, the digital-converted image signals are subjected to density conversion or a filtering treatment and the formed image data are stored in memory as image signals.

The image formation section C performs toner image formation using digital signals formed in the image processing section B and has a unit structure which is assembled of parts used for image formation, as shown in FIG. 1. The image formation unit constituting the image formation section C includes a drum-form photoreceptor 21, and a charger 22 to charge the photoreceptor 21 (charging step) and a developing device 23 to supply a toner to the photoreceptor 21 (developing step) are disposed on the periphery of the photoreceptor 21. Further on the periphery of the photoreceptor 21 are disposed a transfer-conveying belt device 45 as a transfer means to transfer a toner image formed on the photoreceptor 21 onto paper P, a cleaning device 26 to remove the residual toner on the photoreceptor 21 (cleaning step) and a light charge neutralizer 27 of a pre-charge lamp to neutralize the surface of the photoreceptor 21 in preparation for the subsequent image formation (charge neutralization step). These members of from the charger 22 to the light charge neutralizer are arranged in the order of performance in image formation.

A reflection density detector 222 to measure the reflection density of a patch image developed on the photoreceptor 21 is provided downstream from the developing device 23. The photoreceptor 21 is rotationally driven in the designated direction or clockwise.

Next, there will be described exposure of the photoreceptor to light. The photoreceptor 21 is rotated by a driving means not shown in the drawing, and the photoreceptor is uniformly charged during rotation by the charger 22 and imagewise exposed by an exposure optical system, designated as an imagewise exposing means 30 (imagewise exposure step), based on image signals called out of the memory of the image processing section B.

The imagewise exposing means 30 which corresponds to a writing means to write image data onto the photoreceptor 21 employs a laser diode not shown, as an emission source and performs main-scanning by an exposure light transmitted by a polygon mirror 31, a fθ lens 34, a cylindrical lens 35 and a reflection mirror 32. The thus transmitted exposure light is irradiated onto the photoreceptor 21 at the position ($A_o$) to perform imagewise exposure with rotating the photoreceptor 21 (sub-scanning) to form a latent image.

In the present invention, a semiconductor laser or an emission diode at an emission wavelength of 350 to 500 nm is used as an exposure light source to form a latent image on the photoreceptor 21. Exposure is performed preferably at 10 to 50 μm of a dot diameter of exposure light from a light source. Exposure using fine-dots of an emission wavelength and an exposure dot diameter falling within the foregoing range enables to form, on the photoreceptor 21, a highly precise dot image which is responsive to digital image formation. Specifically, when the emission wavelength and the exposure dot diameter fall within the foregoing range, high resolution image formation of not less than 1200 dpi (dpi: number of dots per inch or 2.54 cm) is feasible on the photoreceptor 21.

"Exposure dot diameter" refers to the length of an exposure beam along the main-scanning direction and falling within the region where the intensity of the exposure beam is $1/e^2$ or more of the peak intensity. Examples of a light sources of the exposure beam include a scanning optical system using a semiconductor laser and a solid scanner using a light-emitting diode (LED). The intensity of the exposure beam may be represented in terms of Gauss distribution or Lorentz distribution, but in the present invention, the light intensity distribution is not necessarily specified if formed dots exhibit a diameter of 10 to 50 μm in the region of being $1/e^2$ or more of peak intensity.

A surface-emitting laser array having at least three laser beam emitting points in length and width, which can achieve rapid-writing of latent images on the photoreceptor, is preferable for high-speed print making. Rapid preparation of prints at stable image quality becomes feasible by performing light-exposure with a surface-emitting laser array onto the photoreceptor relating to the present invention which can stably form latent images even when repeating image formation.

A latent image formed on the photoreceptor 21 is developed by supplying a toner with the developing device 23 to form a visible toner image on the surface of the photoreceptor 21. To realize high-precise image formation responsive to digital imaging, it is preferred to use a polymer toner for a developer supplied by the developing device 23. Specifically, such a polymer toner can be prepared by controlling the form or particle size distribution in the process of production. Accordingly, the combined use of a toner, the form and size of which have been controlled in the process of polymerization, and a compound represented by the formula (1) can achieve high-precise image formation of superior sharpness.

The transfer paper conveying section D conveys, toward the subsequent fixing device (50), the paper P onto which a toner image formed at the periphery of the photoreceptor 21 in the image forming section C is transferred by a transfer means 45. The transfer paper conveying section D is provided with paper feeding units 41(A), 41(B) and 41(C) of transfer paper housing means for housing paper sheets differing in size under the image forming unit. Further, a manual paper feed unit 42 for manual paper feeding is provided laterally to the paper feed unit. The transfer paper P is selected by any one of these transfer paper housing means and fed by a guide roller 43 along a transfer path 40.

The transfer paper conveyance section D is provided with paired paper feed resist rollers 44 to adjust inclination or deviation of fed transfer paper P. The transfer paper P is temporarily stopped by the paper feed resist rollers 44 and then again fed. The thus fed transfer paper P is guided to the transfer path 40, a transfer-preceding roller 43*a*, paper feed path 46 and an entrance guide plate 47.

The toner image formed on the photoreceptor 21 is transferred onto the transfer paper P at the transfer position ($B_o$) by a transfer pole 24 and a separation pole 25. The transfer paper P is subject to transfer of the toner image on the paper surface, while being conveyed by a transfer conveyance belt 454 of the transfer mean 45 (transfer-conveyance belt device). The transfer paper P onto which a toner image has been transferred is separated from the surface of the photoreceptor 21 and conveyed by the transfer means 45 toward the fixing device 50.

The fixing device 50 is provided with a fixing roller 51 and a pressure roller 52 and when the transfer paper P passes between the fixing roller 51 and the pressure roller 52, the toner image on transfer paper P is fixed through heating and applying pressure. After the toner image is fixed onto the transfer paper P, the transfer paper P is discharged onto a paper-receiving tray 64.

According to the foregoing procedure, the image forming apparatus of FIG. 1 transfers a toner image onto one side of the transfer paper P to prepare a print material formed of an image on one side. There can also be prepared a print material having toner images transferred onto both sides of the transfer paper P.

In case when toner images are formed on both sides of the transfer paper P, a paper ejection switching member 170 of the transfer paper conveyance section D is operated to open a transfer paper guide 177, whereby the transfer paper P having a toner image formed on one side is conveyed in the direction indicated by the dashed arrow. The transfer paper P is conveyed downward by a conveyance mechanism 178 and switches back at a transfer paper-reversing portion 179, and the back end of the transfer paper P becomes the top end and is transferred to the inside of a dual print paper-supplying unit 130.

The transfer paper P moves in the paper-supplying direction along a conveyance guide 131 provided in the dual print paper-supplying unit 130 and the transfer paper P is again inserted in a web roller 132 and guided to the transfer path 40 According to the procedure described above, the transfer paper P is conveyed toward the photoreceptor 21, and after a toner image is transferred onto the back surface of the transfer paper P and fixed by the fixing device 50, the transfer paper P is discharged onto a copy receiving tray 64. Following the foregoing steps, there can be prepared a print having toner images on both surfaces of the transfer paper P The image forming apparatus shown in FIG. 1 may employ a system in which constituent elements such as the photoreceptor 21, the developing device 23, the cleaner 26 and the like are integrated to form a so-called process cartridge of a unit structure which is easily detachable from the main body of the apparatus. In addition to unitization of plural constituent elements such a process cartridge as described above, at least one of a charger, an imagewise exposure device, a developing device, a transfer or separation device and a cleaner may be integrated with the photoreceptor 21 to form a cartridge unit which is easily detachable from the apparatus body.

A toner image formed by using the electrophotographic photoreceptor relating to the present invention is finally transferred onto the transfer paper P and fixed thereto through the fixing step. The transfer paper P is a support to hold a toner image, which is usually called an image support, a recording material or a transfer material. Specific examples thereof include copy paper of plain paper or high quality paper, coated paper for printing such as art paper or coat paper, commercially available Japanese paper or post card paper, plastic film used for OHP and cloth but are not limited to these in the present invention.

EXAMPLES

The present invention will be further described with reference to examples but the embodiments of the present invention are by no means limited to these.

Synthesis of Charge Generation Material

According to the following procedure were synthesized ten kinds of charge generation materials (CGM 1-10).

Synthesis of CGM 1 (X=Br, n=2):

Into 50 parts by mass of chlorosulfuric acid were added 5.0 parts by mass of 8,16-pyranthrenedione and 0.1 part by mass of iodine and further thereto, 1.9 parts by mass of bromine were dropwise added. After being heated with stirring at 60° C. for 2 hrs and then cooled to room temperature, the reaction mixture was poured into 500 parts by mass of ice. After being filtered, washed and dried, 5.7 parts by mass of a coarse pigment product was obtained. Into a Pyrex (trade name) glass tube was placed 5.0 parts by mass of the obtained coarse pigment product. The tube was placed in the inside of a furnace to cause a temperature gradient of approximately 440° C. to approximately 20° C. along the tube (that is, a temperature gradient of approximately 440° C. to approximately 20° C. per a length of 1 m). The inside of the glass tube was evacuated to a pressure of $1\times10^{-2}$ Pa and the position in which the pigment coarse product to be purified was placed, was heated to approximately 440° C. The produced vapor was transferred to the lower temperature side of the tube and condensed in the region of 280° C. to 400° C. to obtain 2.8 parts by mass of a sublimed material (CGM 1, X=Br, n=2, m=0).

Synthesis of CGM 2 (X=Br, n=3):

Into 50 parts by mass of chlorosulfuric acid were added 5.0 parts by mass of 8,16-pyranthrenedione and 0.1 part by mass of iodine and further thereto, 3.1 parts by mass of bromine were dropwise added. After being heated with stirring at 60° C. for 8 hrs and then cooled to room temperature, the reaction mixture was poured into 500 parts by mass of ice. After being filtered, washed and dried, 7.2 parts by mass of a coarse pigment product was obtained. Into a Pyrex (trade name) glass tube was placed 5.0 parts by mass of the obtained coarse pigment product. The tube was placed in the inside of a furnace to cause a temperature gradient of approximately 460° C. to approximately 20° C. along the tube (that is, a temperature gradient of approximately 460° C. to approximately 20° C. per a length of 1 m). The inside of the glass tube was evacuated to a pressure of $1\times10^{-2}$ Pa and the position in which the pigment coarse product to be purified was placed was heated to approximately 460° C. The produced vapor was transferred to the lower temperature side of the tube and condensed in the region of 300° C. to 410° C. to obtain 2.7 parts by mass of a sublimed material (CGM 2, X=Br, n=3, m=0).

Synthesis of CGM 3 (X=Br, n=4):

Into 50 parts by mass of chlorosulfuric acid were added 5.0 parts by mass of 8,16-pyranthrenedione and 0.25 part by mass of iodine and further thereto, 5.0 parts by mass of bromine were dropwise added. After being heated with stirring at 60° C. for 10 hrs and then cooled to room temperature, the reaction mixture was poured into 500 parts by mass of ice. After being filtered, washed and dried, 8.6 parts by mass of a coarse pigment product was obtained. Into a Pyrex (trade name) glass tube was placed 5.0 parts by mass of the obtained coarse pigment product. The tube was placed in the inside of a furnace to cause a temperature gradient of approximately 480° C. to approximately 20° C. along the tube (that is, a temperature gradient of approximately 480° C. to approximately 20° C. per a length of 1 m). The inside of the glass tube was evacuated to a pressure of $1\times10^{-2}$ Pa and the position in which the pigment coarse product to be purified was placed was heated to approximately 480° C. The produced vapor was transferred to the lower temperature side of the tube and condensed in the region of 300° C. to 420° C. to obtain 3.3 parts by mass of a sublimed material (CGM 3, X=Br, n=4, m=0).

Synthesis of CGM 4 (X=Br, n=5):

Into 50 parts by mass of chlorosulfuric acid were added 5.0 parts by mass of 8,16-pyranthrenedione and 0.3 part by mass of iodine and further thereto, 6.5 parts by mass of bromine were dropwise added. After being heated with stirring at 75° C. for 10 hrs and then cooled to room temperature, the reaction mixture was poured into 500 parts by mass of ice. After being filtered, washed and dried, 9.3 parts by mass of a coarse pigment product was obtained. Into a Pyrex (trade name) glass tube was placed 5.0 parts by mass of the obtained coarse pigment product. The tube was placed in the inside of a furnace to cause a temperature gradient of approximately 490° C. to approximately 20° C. along the tube (that is, a temperature gradient of approximately 490° C. to approximately 20° C. per a length of 1 m). The inside of the glass tube was evacuated to a pressure of $1\times10^{-2}$ Pa and the position in which the pigment coarse product to be purified was placed was heated to approximately 490° C. The produced vapor was transferred to the lower temperature side of the tube and condensed in the region of 300° C. to 440° C. to obtain 2.4 parts by mass of a sublimed material (CGM 4, X=Br, n=5, m=0).

Synthesis of CGM 5 (X=Cl, n=2):

Into 50 parts by mass of chlorosulfuric acid were added 5.0 parts by mass of 8,16-pyranthrenedione and 0.1 part by mass of iodine and further thereto, 2.5 parts by mass of sulfuryl chloride were dropwise added. After being heated with stirring at 55° C. for 2 hrs and then cooled to room temperature, the reaction mixture was poured into 500 parts by mass of ice. After being filtered, washed and dried, 4.4 parts by mass of a coarse pigment product was obtained. Into a Pyrex (trade name) glass tube was placed 5.0 parts by mass of the obtained coarse pigment product. The tube was placed in the inside of a furnace to cause a temperature gradient of approximately 420° C. to approximately 20° C. along the tube (that is, a temperature gradient of approximately 420° C. to approximately 20° C. per a length of 1 m). The inside of the glass tube was evacuated to a pressure of $1\times10^{-2}$ Pa and the position in which the pigment coarse product to be purified was placed was heated to approximately 420° C. The produced vapor was transferred to the lower temperature side of the tube and condensed in the region of 300° C. to 380° C. to obtain 2.4 parts by mass of a sublimed material (CGM 5, X=Cl, n=2, m=0).

Synthesis of CGM 6 (X=Cl, n=3):

Into 50 parts by mass of chlorosulfuric acid were added 5.0 parts by mass of 8,16-pyranthrenedione and 0.1 part by mass of iodine and further thereto, 3.5 parts by mass of sulfuryl chloride were dropwise added. After being heated with stirring at 55° C. for 8 hrs and then cooled to room temperature, the reaction mixture was poured into 500 parts by mass of ice. After being filtered, washed and dried, 5.5 parts by mass of a coarse pigment product was obtained. Into a Pyrex (trade name) glass tube was placed 5.0 parts by mass of the obtained coarse pigment product. The tube was placed in the inside of a furnace to cause a temperature gradient of approximately 430° C. to approximately 20° C. along the tube (that is, a temperature gradient of approximately 430° C. to approximately 20° C. per a length of 1 m). The inside of the glass tube was evacuated to a pressure of $1\times10^{-2}$ Pa and the position in which the pigment coarse product to be purified was placed was heated to approximately 430° C. The produced vapor was transferred to the lower temperature side of the tube and condensed in the region of 300° C. to 390° C. to obtain 2.7 parts by mass of a sublimed material (CGM 6, X=Cl, n=3, m=0).

Synthesis of CGM 7 (X=Cl n=4):

Into 50 parts by mass of chlorosulfuric acid were added 5.0 parts by mass of 8,16-pyranthrenedione and 0.25 part by mass of iodine and further thereto, 3.5 parts by mass of sulfuryl chloride were dropwise added. After being heated with stirring at 60° C. for 10 hrs and then cooled to room temperature, the reaction mixture was poured into 500 parts by mass of ice. After being filtered, washed and dried, 6.7 parts by mass of a coarse pigment product was obtained. Into a Pyrex (trade name) glass tube was placed 5.0 parts by mass of the obtained coarse pigment product. The tube was placed in the inside of a furnace to cause a temperature gradient of approximately 420° C. to approximately 20° C. along the tube (that is, a temperature gradient of approximately 420° C. to approximately 20° C. per a length of 1 m). The inside of the glass tube was evacuated to a pressure of $1\times10^{-2}$ Pa and the position in which the pigment coarse product to be purified was placed was heated to approximately 420° C. The produced vapor was transferred to the lower temperature side of the tube and condensed in the region of 300° C. to 400° C. to obtain 2.6 parts by mass of a sublimed material (CGM 7, X=Cl, n=4, m=0).

Synthesis of CGM 8 (X=Br, Y=Cl, m=2, n=1):

Into 50 parts by mass of chlorosulfuric acid were added 5.0 parts by mass of dibromopyranthrone and 0.1 part by mass of iodine and further thereto, 1.3 parts by mass of sulfuryl chloride were dropwise added. After being heated with stirring at 60° C. for 2 hrs and then cooled to room temperature, the reaction mixture was poured into 500 parts by mass of ice. After being filtered, washed and dried, 5.2 parts by mass of a coarse pigment product was obtained. Into a Pyrex (trade name) glass tube was placed 5.0 parts by mass of the obtained coarse pigment product. The tube was placed in the inside of a furnace to cause a temperature gradient of approximately 450° C. to approximately 20° C. along the tube (that is, a temperature gradient of approximately 450° C. to approximately 20° C. per a length of 1 m). The inside of the glass tube was evacuated to a pressure of $1\times10^{-2}$ Pa and the position in which the pigment coarse product to be purified was placed was heated to approximately 450° C. The produced vapor was transferred to the lower temperature side of the tube and condensed in the region of 300° C. to 390° C. to obtain 2.2 parts by mass of a sublimed material (CGM 8, X=Br, Y=Cl, m=2, n=1).

Synthesis of CGM 9 (X=Br, Y=Cl, m=2, n=2):

Into 50 parts by mass of chlorosulfuric acid were added 5.0 parts by mass of dibromopyranthrone and 0.1 parts by mass of iodine and further thereto, 2.5 parts by mass of sulfuryl chloride were dropwise added. After being heated with stirring at 60° C. for 5 hrs and then cooled to room temperature, the reaction mixture was poured into 500 parts by mass of ice. After being filtered, washed and dried, 5.4 parts by mass of a coarse pigment product was obtained. Into a Pyrex (trade name) glass tube was placed 5.0 parts by mass of the obtained coarse pigment product. The tube was placed in the inside of a furnace to cause a temperature gradient of approximately 460° C. to approximately 20° C. along the tube (that is, a temperature gradient of approximately 460° C. to approximately 20° C. per a length of 1 m). The inside of the glass tube was evacuated to a pressure of $1\times10^{-2}$ Pa and the position in which the pigment coarse product to be purified was placed was heated to approximately 460° C. The produced vapor was transferred to the lower temperature side of the tube and condensed in the region of 300° C. to 400° C. to obtain 2.3 parts by mass of a sublimed material (CGM 9, X=Br, Y=Cl, m=2, n=2).

Synthesis of CGM 10 (X=Br, Y=Cl, m=2, n=3):

Into 50 parts by mass of chlorosulfuric acid were added 5.0 parts by mass of dibromopyranthrone and 0.1 part by mass of iodine and further thereto, 3.5 parts by mass of sulfuryl chloride were dropwise added. After being heated with stirring at 60° C. for 10 hrs and then cooled to room temperature, the reaction mixture was poured into 500 parts by mass of ice. After being filtered, washed and dried, 5.5 parts by mass of a coarse pigment product was obtained. Into a Pyrex (trade name) glass tube was placed 5.0 parts by mass of the obtained coarse pigment product. The tube was placed in the inside of a furnace to cause a temperature gradient of approximately 470° C. to approximately 20° C. along the tube (that is, a temperature gradient of approximately 470° C. to approximately 20° C. per a length of 1 m). The inside of the glass tube was evacuated to a pressure of $1\times10^{-2}$ Pa and the position in which the pigment coarse product to be purified was placed was heated to approximately 470° C. The produced vapor was transferred to the lower temperature side of the tube and condensed in the region of 300° C. to 410° C. to obtain 2.0 parts by mass of a sublimed material (CGM 10, X=Br, Y=Cl, m=2, n=3).

Preparation of Photoreceptor

Photoreceptor 1:

An interlayer, a charge generation layer and a charge transfer layer were successively formed on a cylindrical support in the following procedure, whereby photoreceptor 1 was prepared.

First, the surface of a cylindrical aluminum support was machined to prepare an electrically conductive support exhibiting a ten-point surface roughness of 1.5 μm.

Formation of Interlayer

On the above-described conductive support was coated by the dip-coating method an interlayer coating solution composed of the composition described below, and dried at 120° C. for 30 min. to form an interlayer 1 of 1.0 μm dry thickness. The interlayer coating solution was prepared in the manner described below, then diluted twice with mixed solvents which were used in the preparation of the coating solution, allowed to stand for one day and night and finally filtered. Filtration was conducted using Rigimesh Filter (nominal filtration accuracy: 5 μm, produced by Nippon Pall Co.) under pressure of 50 kPa.

| | |
|---|---|
| Binder resin (polyamide, as below) | 1.0 part |
| Rutile-form titanium oxide* (primary particle size: 35 nm) | 3.5 parts |
| Solvent (ethanol/n-propyl alcohol/ tetrahydrofuran, 45/20/30 by mass) | 10.0 parts |

*Titanium oxide was previously surface-treated with copolymer of methyl hydrogen siloxane and dimethylsiloxane (molar ratio 1:1) in an amount of 5% by mass of the total titanium oxide.

The above-described components were mixed and batchwise dispersed for 10 hr. by using a sand mill, and then, the coating solution was prepared according to the procedure described above.

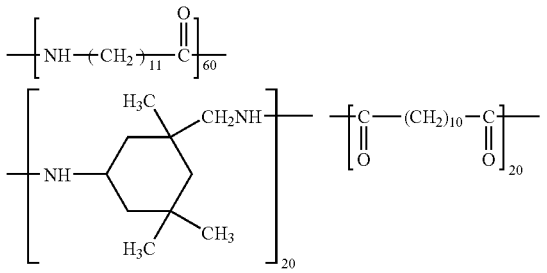

Preparation of Charge Generation Layer:

| | |
|---|---|
| Charge generation material (CGM 1) | 9.6 parts |
| Charge generation material (CGM 2) | 14.4 parts |
| Polyvinyl butyral resin S-LEC BL-S (produced by Sekisui Kagaku Co.) | 4.0 parts |
| 2-Butanine/cyclohexanone mixture (volume ratio: 4/1) | 300 parts |

The charge generation material used each of the foregoing compounds 1-7. The above-described composition was mixed and dispersed by a sand mill dispersing machine (beads: Hi-B D24, produced by OHARA Co., filling ratio: 80%, rotation speed: 1000 rpm) over 10 hrs. to prepare a coating solution of a charge generation layer. The coating solution was coated on the interlayer 1 by the dip coating method to have a dry thickness of 0.5 μm to form charge generation layer 1.

Similarly to the foregoing, charge generation layers used in the individual photoreceptors were prepared. Charge generation materials used in the individual photoreceptors are shown in Table 1.

Preparation of Charge Transport Layer:

| | |
|---|---|
| Charge transport material (CTM-6) | 225.0 parts |
| Polycarbonate Z300 (produced by Mitsubishi Gas Kagaku) | 300.0 parts |
| Antioxidant Irganox 1010 (Nihon Ciba-Geigy KK) | 6.0 parts |
| Tetrahydrofuran/toluene mixture (volume ratio: 3/1) | 2000.0 parts |
| Silicone oil KF-54 (produced by Shinetsu Kagaku Co.). | 1.0 part |

As a charge transport material (hereinafter, also denoted simply as CTM) was used CTM-6, as described earlier. The above-described composition was mixed and dispersed by using a sand mill to prepare a coating solution for a charge transport layer. The coating solution was coated on the foregoing charge generation layer 1 by the dip coating method to form a charge transport layer 1 of a 20 μm dry thickness.

Photoreceptors 2-22:

Photoreceptors 2-22 were each prepared similarly to the photoreceptor 1, provided that the charge generation materials (CGM 1 and CGM 2) used in the photoreceptor 1 were changed, as shown in Table 1.

In addition to the foregoing photoreceptors 1-22, sheet-formed photoreceptors 1-22 in which the interlayer, the charge generation layer and the charge transfer layer were layered on an aluminum-deposited polyester sheet (thickness of 100 μm) similarly to the foregoing were also prepared for use in evaluation of sensitivity by using EPA-8100.

EVALUATION EXPERIMENT

(1) Evaluation-1

Using an electrostatic copying paper test apparatus EPA-8100 (produced by Kawaguchi Denki Co., Ltd.), sheet-formed photoreceptors 1-22 were each evaluated with respect to sensitivity and repetition characteristic, as follows.

Sensitivity:

Each of the photoreceptors was electrically charged so that the surface potential became −700 V, then, exposed to a 420 nm monochromatic light separated by a monochrometer and the amount of light necessary to allow the surface potential to decay to −350 V to determine sensitivity (E1/2).

Sensitivities for monochromatic light of 380 nm and 500 nm were also determined similarly.

Repetition Characteristic:

The initial dark potential (Vd) and the initial light potential (Vl) were each set to −700 V and −200 V, respectively and charging and exposure were repeated 300 times using a 400 nm monochromatic light to determine variations of Vd and Vl (denoted as ΔVd, ΔV1).

The foregoing results are shown in Table 1, in which the minus sign represents lowering of potential and the plus sign represents rising of potential.

TABLE 1

| Photo-receptor | Charge Generation Material | Content*1 | Charge Transfer | Sensitivity (μJ/cm²) | | | Repetition Characteristic (V) | |
|---|---|---|---|---|---|---|---|---|
| No. | (mass %) | (mass %) | Material | 380 nm | 420 nm | 500 nm | ΔVd | ΔV1 |
| 1 | CGM1(17)/CGM2(83) | 83 | CTM-6 | 0.35 | 0.19 | 0.17 | −23 | 28 |
| 2 | CGM1(17)/CGM3(83) | 83 | CTM-6 | 0.34 | 0.3 | 0.3 | −19 | 45 |
| 3 | CGM2(33)/CGM3(67) | 67 | CTM-6 | 0.24 | 0.18 | 0.17 | −20 | 26 |
| 4 | CGM2(33)/CGM3(67) | 67 | CTM-16 | 0.25 | 0.2 | 0.18 | −24 | 29 |
| 5 | CGM2(33)/CGM3(67) | 67 | CTM-6 | 0.27 | 0.23 | 0.23 | −27 | 34 |
| 6 | CGM2(33)/CGM3(67) | 67 | CTM-20 | 0.25 | 0.22 | 0.2 | −28 | 28 |
| 7 | CGM2(33)/CGM3(67) | 67 | CTM-22 | 0.25 | 0.2 | 0.18 | −24 | 29 |
| 8 | CGM2(17)/CGM3(83) | 83 | CTM-6 | 0.35 | 0.19 | 0.17 | −23 | 28 |
| 9 | CGM2(8)/CGM3(92) | 92 | CTM-6 | 0.34 | 0.3 | 0.3 | −19 | 45 |
| 10 | CGM3(83)/CGM4(17) | 83 | CTM-6 | 0.3 | 0.27 | 0.25 | −17 | 39 |
| 11 | CGM2(17)/CGM3(66)/CGM4(17) | 66 | CTM-6 | 0.27 | 0.25 | −17 | −29 | 36 |
| 12 | CGM5(33)/CGM6(67) | 67 | CTM-6 | 0.47 | 0.38 | 0.37 | −15 | 30 |
| 13 | CGM5(33)/CGM7(67) | 67 | CTM-6 | 0.45 | 0.38 | 0.37 | −50 | 25 |
| 14 | CGM6(17)/CGM7(83) | 83 | CTM-6 | 0.42 | 0.37 | 0.36 | −45 | 38 |

TABLE 1-continued

| Photo-receptor No. | Charge Generation Material (mass %) | Content*1 (mass %) | Charge Transfer Material | Sensitivity (μJ/cm²) 380 nm | 420 nm | 500 nm | Repetition Characteristic (V) ΔVd | ΔV1 |
|---|---|---|---|---|---|---|---|---|
| 15 | CGM6(83)/CGM7(17) | 83 | CTM-6 | 0.38 | 0.35 | 0.34 | −20 | 26 |
| 16 | CGM8(17)/CGM9(83) | 83 | CTM-6 | 0.3 | 0.26 | 0.25 | −35 | 40 |
| 17 | CGM9(83)/CGM10(17) | 83 | CTM-6 | 0.27 | 0.23 | 0.22 | −29 | 33 |
| 18 | CGM8(8)/CGM9(84)/CGM10(8) | 83 | CTM-6 | 0.24 | 0.18 | 0.17 | −20 | 25 |
| 19 | CGM3(100) | 100 | CTM-6 | 0.27 | 0.24 | 0.25 | −39 | 35 |
| 20 | CGM6(100) | 100 | CTM-6 | 0.49 | 0.44 | 0.42 | −28 | 47 |
| 21 | CGM9(100) | 100 | CTM-6 | 0.26 | 0.23 | 0.22 | −40 | 30 |
| 22 | CGM1(17)/CGM2(83) | 83 | CTM-X | 2.9 | 0.78 | 0.23 | −18 | 68 |

*1Content (mass %) of a CGM of the maximum proportion

As is apparent from Table 1, it was proved that photoreceptors 1-18 and 22 were each superior in sensitivity and repetition characteristic, compared to photoreceptors 19-21.

(2) Evaluation-2

A modified machine of a commercially available digital printer, bizhub 920, produced by Konica Minolta Business Technology Inc (modified to use a 405 nm semiconductor laser as a light source for image exposure) was employed as a evaluation machine. Each of the photoreceptors 1-22 was installed in this modified machine to perform evaluation. Using the above-described machine, exposure to a short wavelength laser light was conducted and intermittent printing was performed on 10,000 sheets of high quality A4 paper (64 g/m²) under the respective exposure conditions.

The intermittent printing was set so that when a print in process of making was conveyed onto a copy receiving tray, the subsequent was started. Printing was conducted under an environment of ordinary temperature and ordinary humidity (20° C., 55% RH) and image evaluation was made using printed materials outputted at about the 40th sheet and also at about the 10,000th sheet. There was used a face-emitting laser array having three laser beams each in the longitudinal and lateral directions, respectively, as an exposure device of the short wavelength laser light.

Image evaluation was made with respect to black-spotting, dot reproducibility and fine-line reproducibility. The image outputted in printing was an A4 size image (7% in terms of pixel ratio), in which a fine-line image (8 lines/mm, 6 lines/mm, 4 lines/mm), a halftone image (image density of 0.8), a white background image and a solid image (image density of 1.30), each equally accounting for a quadrant of the sheet.

Black-Spotting:

Black-spotting was evaluated in such a manner that the number of visually observable black spots (having a diameter of 0.4 mm or more) formed on the about 40th and 3000th sheets and from the observation results, evaluation was made by equivalence conversion to the number of spots on the A4 size sheet. It was evaluated that the number of 10 spots/A4 size or less was acceptable and the number of 3 spots/A4 size or less was specifically preferable.

Dot Reproducibility

When reached about the 40th and 10,000th sheets during printing, printing was conducted by varying the exposure diameter of the laser beam and independency of dots forming a halftone image on the print was evaluated through observation with a magnifier at 10-fold magnification. Specifically, printing was performed with varying the exposure beam diameter in the writings main-scanning direction to 10 μm, 21 μm or 50 μm, provided that the exposure diameter of 38th and 9998th sheets was set to 10 μm, that of 39th and 9999th sheets was set to 21 μm, and that of 40th and 10000th sheets was set to 50 μm. An exposure beam diameter of 10 μm corresponds to the dot number of approximately 2500 dpi, that of 21 μm corresponds to the dot number of approximately 1200 dpi and that of 50 μm corresponds to the dot number of approximately 500 dpi. Observation results were evaluated based on the following criteria, in which ranks A to C were acceptable in practice.

A: It was confirmed that dots constituting halftone images were each independently formed at each of 10 μm (corresponding to 250 dpi), 21 μm (corresponding to 1200 dpi) and 50 μm (corresponding to 500 dpi), whereby excellent high image quality was achieved;

B: dot independency was evident in halftone images of 21 μm (corresponding to 1200 dpi) and 50 μm (corresponding to 500 dpi), but dot independency was insufficient in halftone images of 10 μm (corresponding to 2500 dpi);

C: dot independency was evident in halftone images of 50 μm (corresponding to 500 dpi), but dot independency was insufficient in halftone images of 10 μm (corresponding to 2500 dpi) and 21 μm (corresponding to 1200 dpi);

D: independency of dots was insufficient even in a halftone image of 50 μm (corresponding to 500 dpi).

Fine-Line Reproducibility:

Fine-line reproducibility was evaluated in fine-line images printed on the 39th and 9999th sheets. The fine-line portion was magnified by a 10-fold magnifier and the number of fine-lines per 1 mm was visually evaluated. Specifically, as described above, fine-line images were composed of three kinds of fine-line images at 9 line/mm, 6 line/mm and 4 line/mm, in which a-fine-line image with a thin or thick portion on the fine-line was judged to be a defective print but a fine-line image in which no thin or thick portions were observed at 6 line/mm or more was evaluated as acceptable.

Results of the foregoing evaluation are shown in Table 2.

TABLE 2

| | Photo-receptor No. | Black Spotting (spot/A4) 40th Sheet | 10000th Sheet | Dot Reproducibility 40th Sheet | 10000th Sheet | Fine-Line Reproducibility 40th Sheet | 10000th Sheet |
|---|---|---|---|---|---|---|---|
| Example 1 | 1 | 3 | 4 | C | C | 8 | 6 |
| Example 2 | 2 | 2 | 5 | B | B | 8 | 6 |
| Example 3 | 3 | 3 | 6 | A | B | 6 | 6 |
| Example 4 | 4 | 1 | 5 | A | A | 8 | 8 |
| Example 5 | 5 | 4 | 5 | B | B | 8 | 6 |
| Example 6 | 6 | 4 | 8 | B | C | 6 | 6 |

TABLE 2-continued

| | Photo-receptor No. | Black Spotting (spot/A4) | | Dot Reproducibility | | Fine-Line Reproducibility | |
|---|---|---|---|---|---|---|---|
| | | 40th Sheet | 10000th Sheet | 40th Sheet | 10000th Sheet | 40th Sheet | 10000th Sheet |
| Example 7 | 7 | 3 | 4 | A | B | 8 | 8 |
| Example 8 | 8 | 4 | 5 | A | B | 8 | 6 |
| Example 9 | 9 | 6 | 8 | B | C | 6 | 6 |
| Example 10 | 10 | 3 | 7 | A | B | 6 | 6 |
| Example 11 | 11 | 2 | 3 | A | A | 8 | 8 |
| Example 12 | 12 | 5 | 9 | A | B | 8 | 6 |
| Example 13 | 13 | 2 | 4 | A | C | 6 | 6 |
| Example 14 | 14 | 4 | 5 | B | C | 8 | 6 |
| Example 15 | 15 | 3 | 7 | B | C | 8 | 8 |
| Example 16 | 16 | 4 | 7 | A | B | 6 | 6 |
| Example 17 | 17 | 4 | 8 | B | B | 6 | 6 |
| Example 18 | 18 | 1 | 2 | A | B | 8 | 8 |
| Example 19 | 22 | 3 | 4 | C | C | 6 | 6 |
| Comparison 1 | 19 | 8 | 17 | B | C | 4 | * |
| Comparison 2 | 20 | 16 | 35 | A | C | 6 | * |
| Comparison 3 | 21 | 12 | 29 | C | D | 4 | * |

*: Defective print, unacceptable in practice

As is apparent from Table 2, the use of the electrophotographic receptors 1-18 and 22, according to the present invention has achieved satisfactory results in improvement of black spotting, dot image reproduction and fine-line reproduction. Thus, it was proved from the results of the foregoing examples that image formation with a short wavelength laser light of 380-500 nm was effectively performed by use of electrophotographic photoreceptors of the present invention. On the contrary, the use of the electrophotographic photoreceptors 19-21 falling outside the scope of the present invention did not achieve intended results in black spotting, dot image reproduction and fine-line reproduction.

What is claimed is:

1. An electrophotographic photoreceptor comprising on or over an electrically conductive support a photosensitive layer containing a charge generation material and a charge transfer material, wherein the charge generation material is comprised of two or more compounds represented by the following formula (1):

Formula (1)

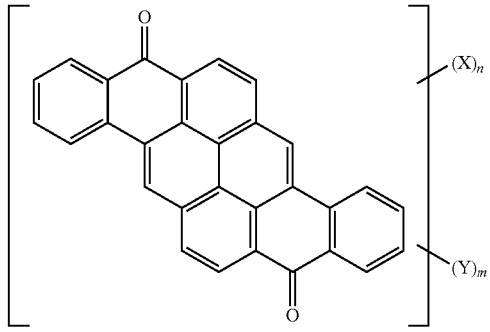

wherein X and Y are each an alkyl group or a halogen atom, n is an integer of 1 to 6 and m is an integer of 0 to 6, and wherein the compounds differ in at least one of m and n of the formula (1), and wherein one of the compounds accounts for a maximum proportion of not more than 90% by mass of the compounds.

2. The electrophotographic photoreceptor of claim 1, wherein in the formula (1), at least one of X and Y is a halogen atom.

3. The electrophotographic photoreceptor of claim 1, wherein in the formula (1), X is a bromine atom.

4. The electrophotographic photoreceptor of claim 1, wherein a compound represented by the formula (1) in which X is a bromine atom and n is 4 accounts for a maximum proportion of the compounds.

5. The electrophotographic photoreceptor of claim 1, wherein a compound represented by the formula (1) in which X is a bromine atom, Y is a chlorine atom, n is 2 and m is 2 accounts for a maximum proportion of the compounds.

6. The electrophotographic photoreceptor of claim 1, wherein the charge transfer material is comprised of a compound represented by the following formula (2):

formula (2)

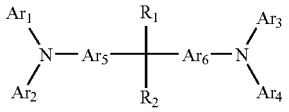

wherein $Ar_1$ to $Ar_4$ are each independently an aryl group; $Ar_5$ and $Ar_6$ are each independently an arylene group, provided that $Ar_1$ and $Ar_2$ or $Ar_3$ and $Ar_4$ may combine with each other to form a ring; $R_1$ and $R_2$ are each independently a hydrogen atom, an alkyl group, an aralkyl group or an aryl group, provided that $R_1$ and $R_2$ may combine with each other to form a ring.

* * * * *